US005355679A

United States Patent [19]

Pierce

[11] Patent Number: 5,355,679

[45] Date of Patent: Oct. 18, 1994

[54] HIGH RELIABILITY GAS EXPANSION ENGINE

[75] Inventor: James G. Pierce, Columbus, Ohio

[73] Assignee: PHPK Technologies, Incorporated, Columbus, Ohio

[21] Appl. No.: 83,097

[22] Filed: Jun. 25, 1993

[51] Int. Cl.[5] ..... F25B 9/00

[52] U.S. Cl. ..... 62/6; 60/517

[58] Field of Search ..... 62/6; 60/517, 520

[56] References Cited

U.S. PATENT DOCUMENTS

| | | | |
|---|---|---|---|
| 1,574,425 | 2/1926 | Jordan . | |
| 3,101,596 | 8/1963 | Rinia et al. | 62/6 |
| 3,131,547 | 5/1964 | Collins | 62/86 |
| 3,416,307 | 12/1968 | Wallis | 60/24 |
| 3,530,681 | 9/1970 | Dehne | 62/6 |
| 3,832,935 | 3/1974 | Syassen | 92/156 |
| 4,087,988 | 5/1978 | Pallaver et al. | 62/514 JT |
| 4,245,477 | 1/1981 | Glode et al. | 62/6 |
| 4,248,050 | 2/1981 | Durenec | 62/6 |
| 4,310,337 | 12/1982 | Sarcia | 62/6 |
| 4,402,186 | 9/1983 | Feustel et al. | 62/6 |
| 4,403,478 | 9/1983 | Robbins | 62/6 |
| 4,450,685 | 5/1984 | Corey | 62/6 |
| 4,466,251 | 8/1984 | Chellis et al. | 62/6 |
| 4,543,793 | 10/1985 | Chellis et al. | 62/6 |
| 4,619,112 | 10/1986 | Colgate | 62/6 |
| 4,693,090 | 9/1987 | Blackman | 62/116 |
| 4,708,165 | 11/1987 | Lessard et al. | 137/509 |
| 4,708,725 | 11/1987 | Okumura | 62/6 |
| 4,825,660 | 5/1989 | Okumura | 62/6 |
| 4,870,827 | 10/1989 | McFarlin et al. | 62/6 |
| 4,954,053 | 9/1990 | Isoda et al. | 417/379 |
| 5,092,131 | 3/1992 | Hattori et al. | 62/6 |
| 5,095,700 | 3/1992 | Bolger | 62/6 |

OTHER PUBLICATIONS

Patton, G. et al., "A Helium Liquefier Using Electronically Controlled Hydraulic Expansion Engines." David Taylor Naval Ship Research and Development Center.

Doll, R. et al., "Gas-Lubricated Low-Temperature Piston Expansion Engine Without Control Valve." *Cryogenic Engineering Conference,* vol. 9, (1963), pp. 561-564.

Patton, G. et al., "Hydraulically Controlled Helium Expansion Engine." *Cryogenic Engineering Conference,* vol. 31, pp. 641-648.

Peterson, T., "Fermilab's Satellite Refrigerator Expansion Engines." Fermi National Accelerator Laboratory.

Patton, G. et al., "Computer Controlled Helium Expansion Engine." pp. 1-9.

Peterson, T., "Wet Engine Dead Volume Test Results at the BR Refrigerator."

*Primary Examiner*—Ronald C. Capossela

*Attorney, Agent, or Firm*—C. Michael Gegenheimer

[57] ABSTRACT

An expansion engine incorporates various structural features in which all cold seals are stationary, and only warm seals move. Moving parts which are subject to cryogenic temperatures are designed with gas bearings, while tight tolerances and material choices inhibit wear and steady state heat loss. Numerous other features include structural design to relieve stresses, combined fabrication of key parts, initial bias of the inlet and outlet valves which contract on cooldown to desired alignment, and a gas-purged upper seal housing, eliminate various sources of expansion engine failure and heat loss during operation and result in high reliability and thermal efficiency.

20 Claims, 7 Drawing Sheets

HIGH RELIABILITY GAS EXPANSION ENGINE

BACKGROUND OF THE INVENTION

The present invention relates to cryogenic refrigeration systems, and in particular to an expansion engine used in refrigeration and liquefaction cycles to produce low temperature gases and liquids.

To achieve liquid helium temperatures for applications involving superconducting magnet and solenoid devices, industry has a serious need for highly reliable, high efficiency refrigerator/liquefiers using expansion engines to produce equivalent capacity ranges of 5 to 15 liters per hour of liquid helium.

Among the emerging industrial uses for superconducting components are superconducting magnetic energy storage (SMES) systems which may be used to store and instantaneously provide electrical power to offset damaging voltage dips caused by routine circuit-switching at power substations. Although lasting a fraction of a second, voltage dips can cause significant damage to electronic controllers essential to manufacturing operations, and uninterrupted power sources are thus critical to prevent idling entire manufacturing plants. A single downtime incident in a large manufacturing plant can result in hundreds of thousands of dollars in losses. Total losses in the United States due to voltage dips have been estimated to be more than $12 billion dollars annually.

Essential to commercial viability of SMES is a reliable cryogenic refrigeration/liquefaction system which can supply needed refrigeration at liquid helium temperatures to sustain the superconducting devices therein. Commercially available refrigeration/liquefaction systems providing capacity needed for micro and mini SMES applications exhibit a predictable 3,000 to 4,000 hour mean time between failure rate (4 to 5½ months). Failure is generally attributed to the failure of expansion engines employed in these systems. Sources of expansion engine failure include cryogen leakage, air and oil contamination of cryogens, excessive wear, and fatigue. Commercial acceptance of SMES systems, which function as back-up safety systems, requires that they achieve much higher levels of reliability.

Further, because of the cryogenic temperatures at which expansion engines must operate in such refrigeration/liquefaction systems, low thermal losses and high thermal efficiency are at a premium. Commercially available expansion engines currently exhibit lower thermal efficiencies and higher thermal losses than are desirable.

Accordingly, the need exists for high reliability expansion engines which operate with extended mean times between servicing or failure, with low thermal losses and high efficiencies, to satisfy the demands of various existing and emerging applications involving superconducting devices.

SUMMARY OF THE INVENTION

The present invention satisfies that need by incorporating numerous structural innovations, advanced manufacturing techniques and material combinations, into a single high reliability expansion engine design which achieves low thermal losses and high operating efficiencies. While certain of the structures, techniques, and materials have been used separately in other applications, they have not heretofore been combined in a single expansion engine device to produce the superior characteristics demonstrated by the present invention. Moreover, the design of the present invention is scaleable to enable its broad application in cryogenic refrigerators and liquefiers of different sizes and capacities to meet the demands of different emerging technologies.

The expansion engine of the present invention includes an expansion cylinder, an inlet valve, an outlet valve, a means for mounting the expansion engine, and means for operating the expansion cylinder, inlet valve, and outlet valve in timed relationship. More particularly, the expansion cylinder, inlet valve, and outlet valve all have a first end adapted for exposure to ambient temperatures, and a second end adapted for exposure to cooler, cryogenic operating temperatures. The expansion cylinder includes a cylinder assembly, and a piston slidably disposed in the cylinder assembly for reciprocating motion. The piston defines a variable volume within the cylinder assembly for gas expansion.

In accordance with one representative feature of the present invention, the means for mounting the expansion engine includes a mounting flange rigidly connected to the cylinder assembly at the first (ambient) end of the expansion cylinder. The mounting flange is typically used to mount the expansion engine to a vacuum chamber or vacuum box for operation. The inlet valve, which controls fluid flow into the variable volume, has its second end rigidly connected to the second end of the cylinder assembly, while its first end is slidably disposed in the mounting flange. Likewise, the outlet valve, which controls fluid flow from the variable volume, has its second end rigidly connected to the second end of the cylinder assembly, while its first end is slidably disposed in the mounting flange. This structure permits the inlet and outlet valves to be supported by their respective connections to the cylinder assembly so that upon cooldown, thermal contraction of the cylinder assembly is accompanied by sliding motion of the inlet and outlet valves at their respective first ends through the mounting flange at generally ambient temperatures. All components are thereby secured, yet free to contract and expand as necessary. Differential expansion of the valve and expansion cylinder components and related stresses induced during operation at various temperatures during cooldown and steady state operation are relieved by the sliding motion of the inlet and outlet valves.

More generally, the present design provides various structural features in which all cold seals are stationary, and only warm seals move. Moving parts which are subject to cryogenic temperatures are designed with gas bearings, and tight tolerances and material choices inhibit wear as well as steady state heat loss. These and other features and advantages of the present invention, including combined fabrication of key parts, initial bias of the inlet and outlet valves, and a gas-purged upper seal housing, eliminate various sources of expansion engine failure and heat loss during operation and result in high reliability and thermal efficiency, as further shown and explained in the drawings and detailed description which follow.

DETAILED DESCRIPTION OF THE PREFERRED EMBODIMENTS

Figure 1:
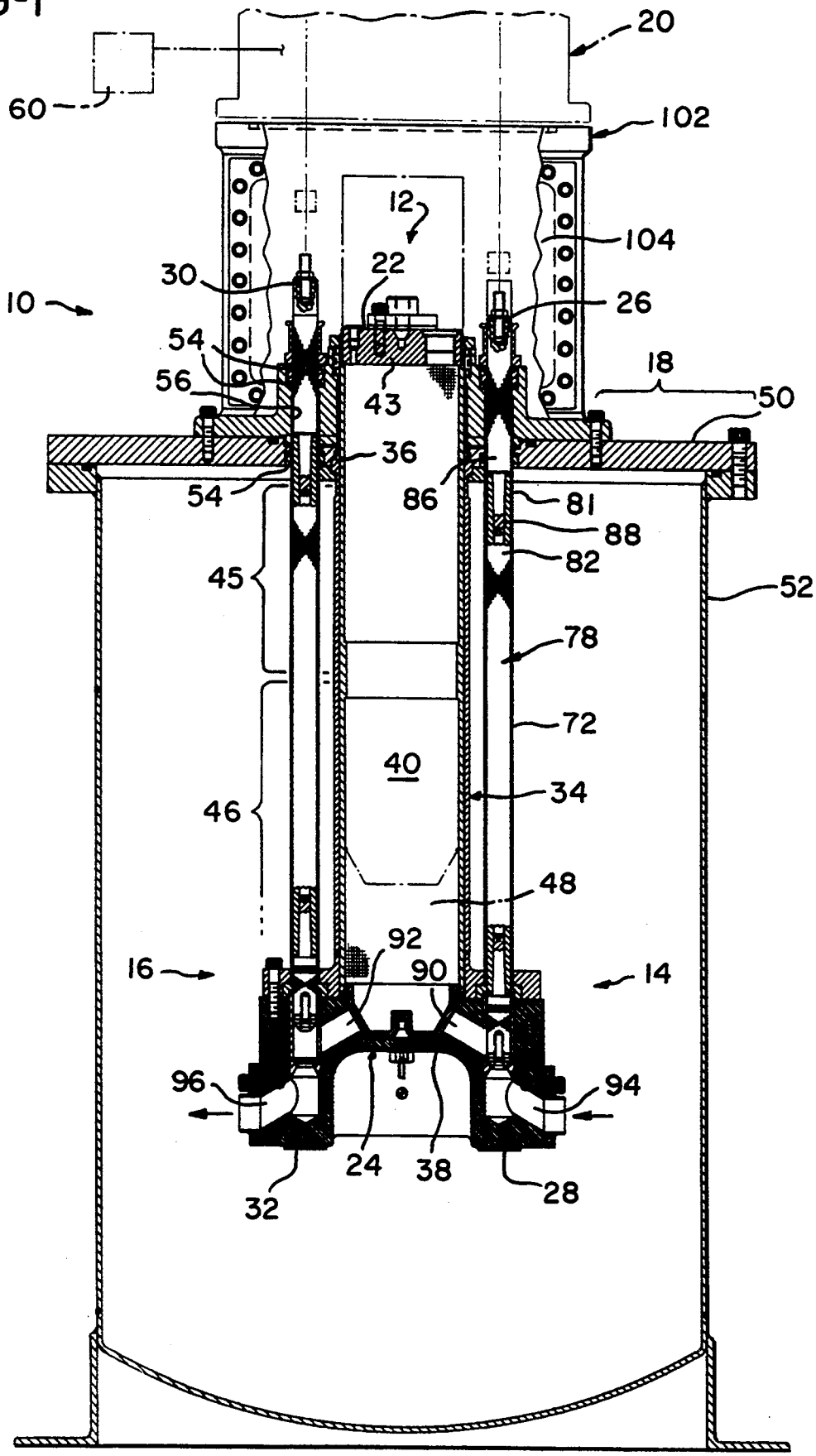
FIG. 1 is a schematic cross-sectional view of a first, preferred embodiment of the expansion engine of the present invention in a representative environment.
Figure 2:
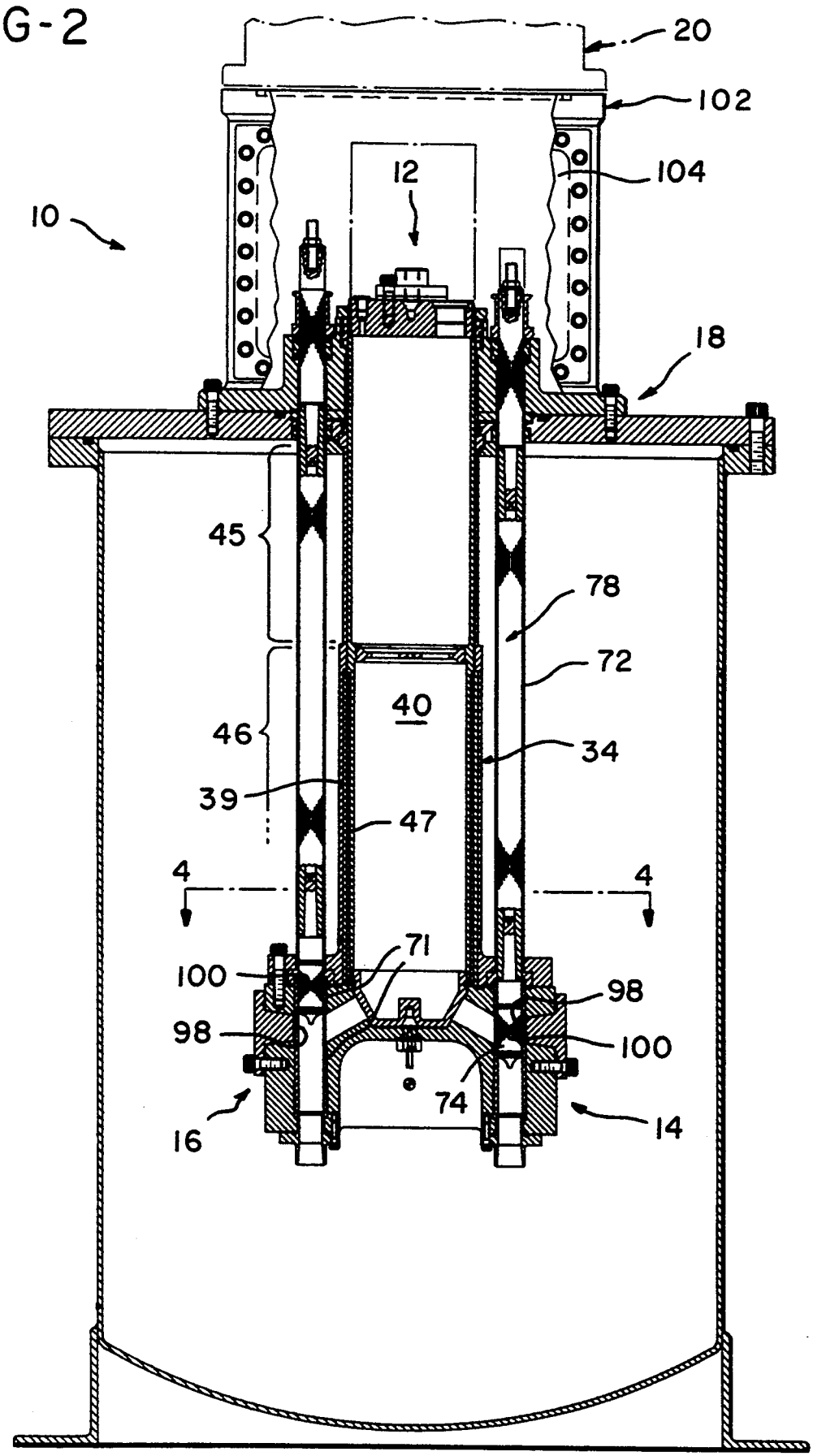
FIG. 2 is a schematic cross-sectional view of a second embodiment of the expansion engine and a second valve design of the present invention in a representative environment.

Referring to FIGS. 1 and 2, the expansion engine 10 of the present invention is shown, and includes an expansion cylinder 12, an inlet valve 14, an outlet valve 16, a means 18 for mounting the expansion engine, and means 20 for operating the expansion cylinder, inlet valve, and outlet valve in timed relationship (indicated in phantom). More particularly, as shown in FIG. 1 the expansion cylinder 12, inlet valve 14, and outlet valve 16 all have respective first ends 22, 26 and 30, adapted for exposure to ambient temperatures, and respective second ends 24, 28 and 32 adapted for exposure to cooler, cryogenic operating temperatures. The expansion cylinder 12 includes a cylinder assembly 34 having first and second ends 36, 38, and a piston 40 slidably disposed in the cylinder assembly 34 for reciprocating motion. The piston defines a variable volume 48 (shown representatively in phantom) within the cylinder assembly 34 for gas expansion.

Still referring to FIG. 1, in accordance with one feature of the present invention, the means 18 for mounting the expansion engine includes a mounting flange 50 rigidly connected to the cylinder assembly 34 at the first (ambient) end 22 of the expansion cylinder. The mounting flange 50 is typically used to mount the expansion engine 10 to a vacuum chamber 52 or box, representatively shown, as an environment for operation. Vacuum in the chamber 52 serves to insulate the expansion engine from heat loss, and such vacuum chambers may also include a shield (not shown) intermediate between the expansion engine 10 and inner walls of the chamber 52. Connecting piping is not shown for clarity, but is understood to extend from connections 110, 112 shown in FIG. 3 to the inlet and outlet valves 14, 16.

The inlet valve 14, which controls fluid flow into the variable volume 48, has its second end 28 rigidly connected to the second end 38 of the cylinder assembly 34, while its first end 26 is slidably disposed in the mounting flange 50. Likewise, the outlet valve 16, which controls fluid flow from the variable volume 48, has its second end 32 rigidly connected to the second end 38 of the cylinder assembly 34, while its first end 30 is slidably disposed in the mounting flange 50. This structure permits the inlet and outlet valves 14, 16 to be supported by their respective connections to the cylinder assembly 34 so that upon cooldown, thermal contraction of the cylinder assembly 34 is accompanied by sliding motion of the inlet and outlet valves 14, 16 at their respective first ends 26, 30 through the mounting flange 50 at generally ambient temperatures. All components are thereby secured, yet free to contract and expand as necessary. Differential expansion of the valves 14, 16 and expansion cylinder components and related stresses induced during operation at various temperatures during cooldown and steady state operation are relieved by the sliding motion of the inlet and outlet valves 14 and 16.

As is best shown in FIG. 1, the mounting flange 50 may be an assembly of several flange elements, and the sliding motion of the valves 14, 16 accommodated by various linear bearings 56 and seals 54, such as O-ring and other seals, which can seal against vacuum in the vacuum chamber 52. The linear bearings 56 through which the first ends 26, 30 of the valves slide provide alignment but no structural support. Although intended for alignment, the linear bearings 56 are also capable of providing some resistance to side loads. Static cold seals are also shown and include metal O-rings 58 as indicated. As may also be understood from FIGS. 1 and 2, where reference herein is made to a component at, or a connection to, the first or second end of another component, such reference is intended to include the component or connection being at, to, or near the first or second end to which reference is made.

Although not shown in detail, the means 20 for operating the expansion cylinder 12, inlet valve 14, and outlet valve 16 in timed relationship may be a variant of any conventional drive for use with expansion engines 10, such as those available from CVI, Inc., Columbus, Ohio. Such drive systems are typically crankshaft driven. While no commercially available drives are immediately applicable to the new structure of the present invention, modifications of known drives by one skilled in the art will provide suitable performance. Great care must be taken in using mechanical drives to avoid oil in-leakage and contamination of the valves and piston. It is preferred that the means 20 for operating produce as little side load on the valves 14, 16 and piston 40 as possible to reduce wear and prevent damage to the seals 54 and bearings 56. It is also preferred that the means 20 for operating includes a controller means 60 which can be used to vary the speed (i.e. cycles per minute) at which the piston 40 and valves 14, 16 cycle.

Although not readily apparent by inspection of FIGS. 1 and 2, it is a further feature of the present invention that the inlet valve 14 and outlet valve 16 are assembled in spaced relationship so that when the expansion engine 10 is at ambient temperature, their second ends 28, 32 are more widely spaced apart, than their first ends 26, 30. Upon cooldown to substantially steady state cryogenic operating temperatures, however, this outward bias is eliminated. The second ends 28, 32 of the valves 14, 16 contract, and become spaced apart a distance generally equal to the spacing between the first ends 26, 30. Thus, while some friction may be initially imposed in the valve operation during cooldown (typically lasting several hours) due to the initial bias of the inlet and outlet valves 14 16, longer term operation (up to a year or longer) at steady state temperatures occurs with the valves 14, 16 being in generally parallel, spaced relationship, and with alignment which allows the valves to operate on gas bearings accompanied without substantial contact or wear between adjacent surfaces. Accordingly, more reliable, extended steady state operation is achieved.

Figure 1A:
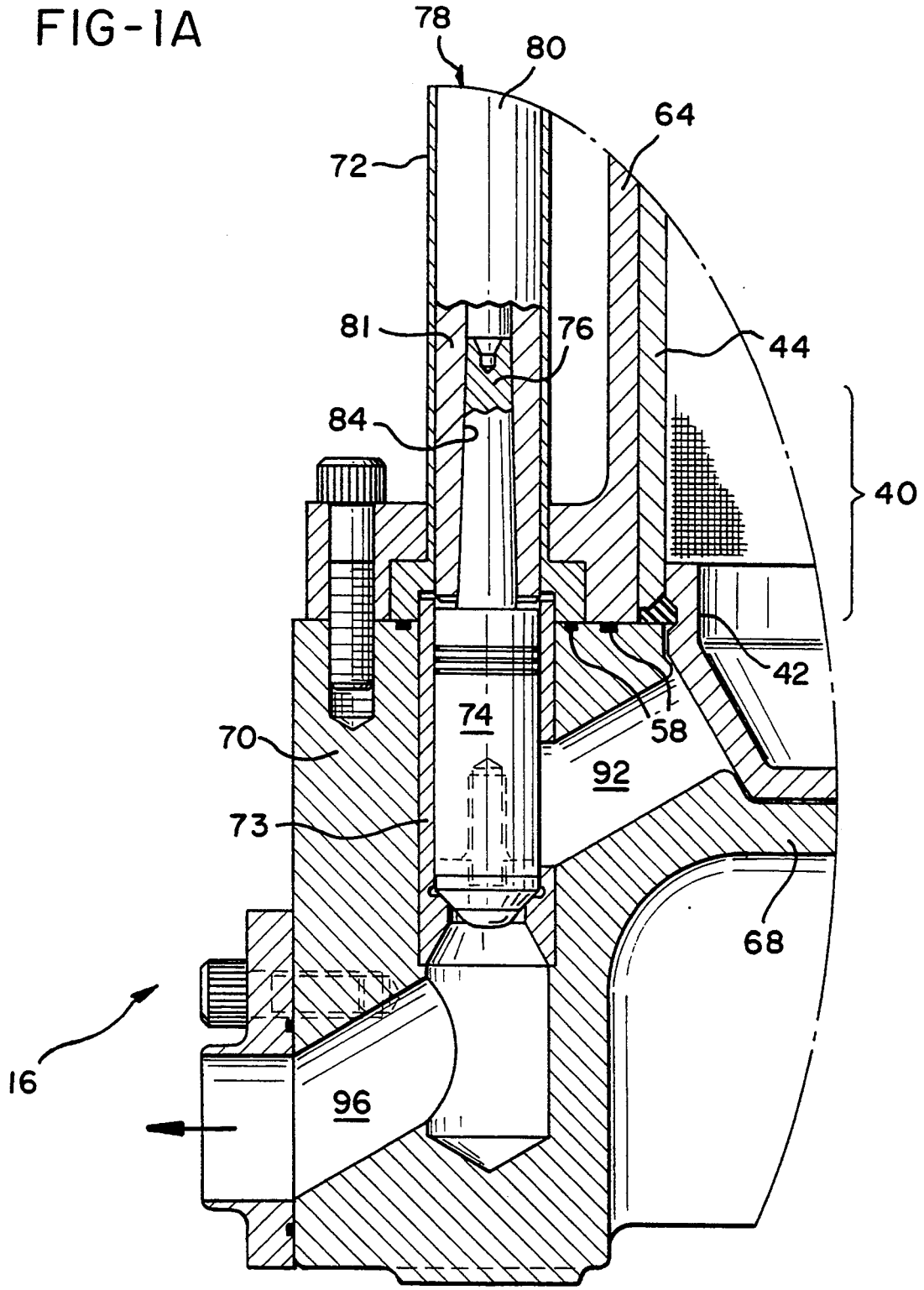
FIG. 1A is a detail cross-sectional view of the valve and piston design of FIG. 1.
Figure 2A:
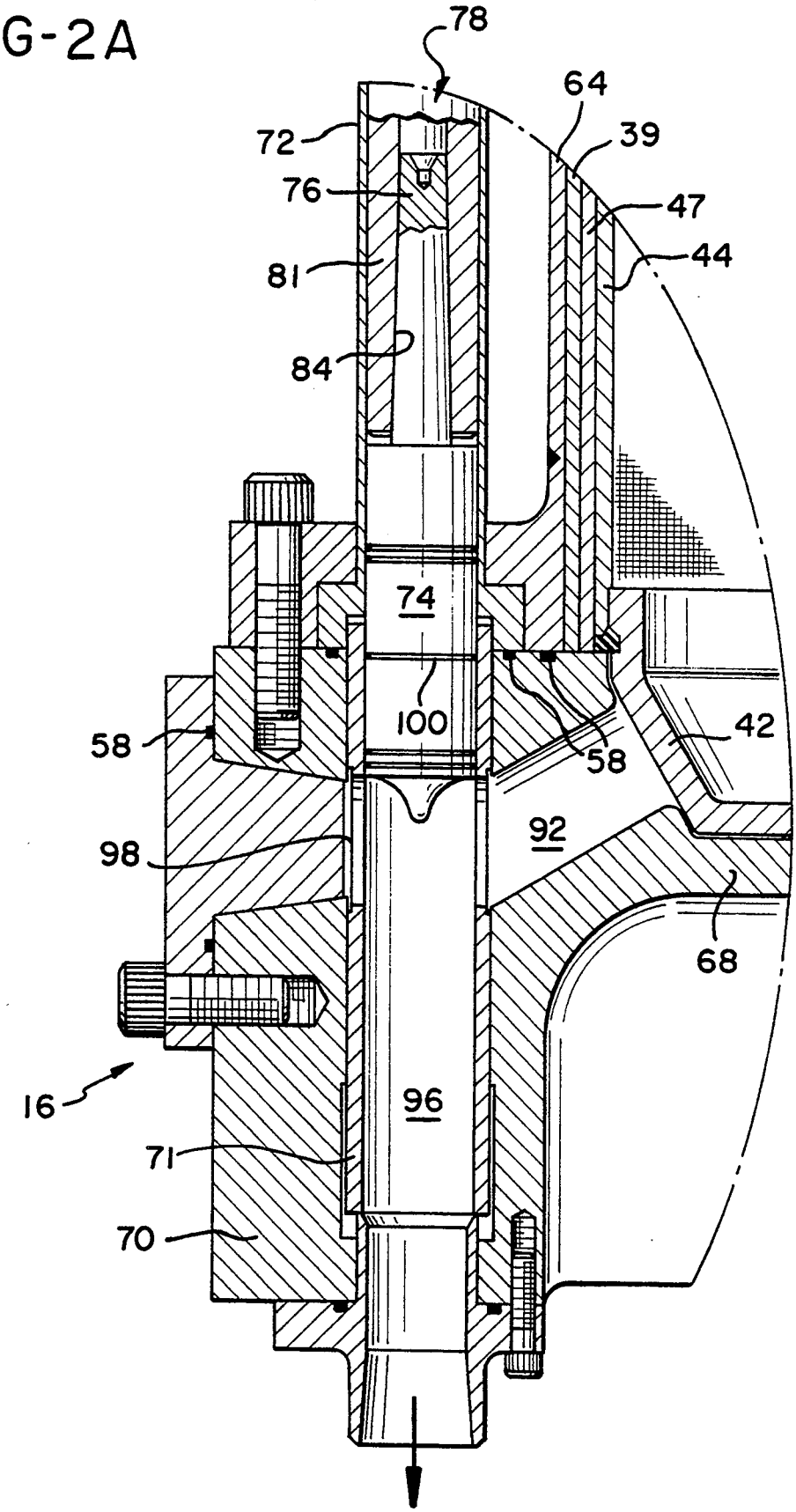
FIG. 2A is a detail cross-sectional view of a the valve design of FIG. 2.

With further reference to FIGS. 1A and 2A, the cylinder assembly 34, inlet valve 14, and outlet valve 16 may be described in greater detail. Cylinder assembly 34 includes a cylinder assembly end cap 68 at the second (cold) end 38 of the expansion cylinder, and a cylinder tube 64.

The inlet valve 14 and outlet valve 16 of the present invention are of the same construction, and like numerals will be used to describe like parts applicable to each. Each of the valves 14, 16 includes a valve body 70 disposed at the second end of the valve, and a valve housing 72 extending from the valve body 70 toward the first end of the valve. A valve head 74 is slidably disposed for reciprocal motion in portions of the valve body 70 and valve housing 72 to control flow through the valve. A valve stem 78 is connected to and extends from the valve head 74 to the first end of the valve, and is slidably disposed for reciprocal motion in portions of the valve body 70 and valve housing 72 for operation of the valve.

Figure 4:
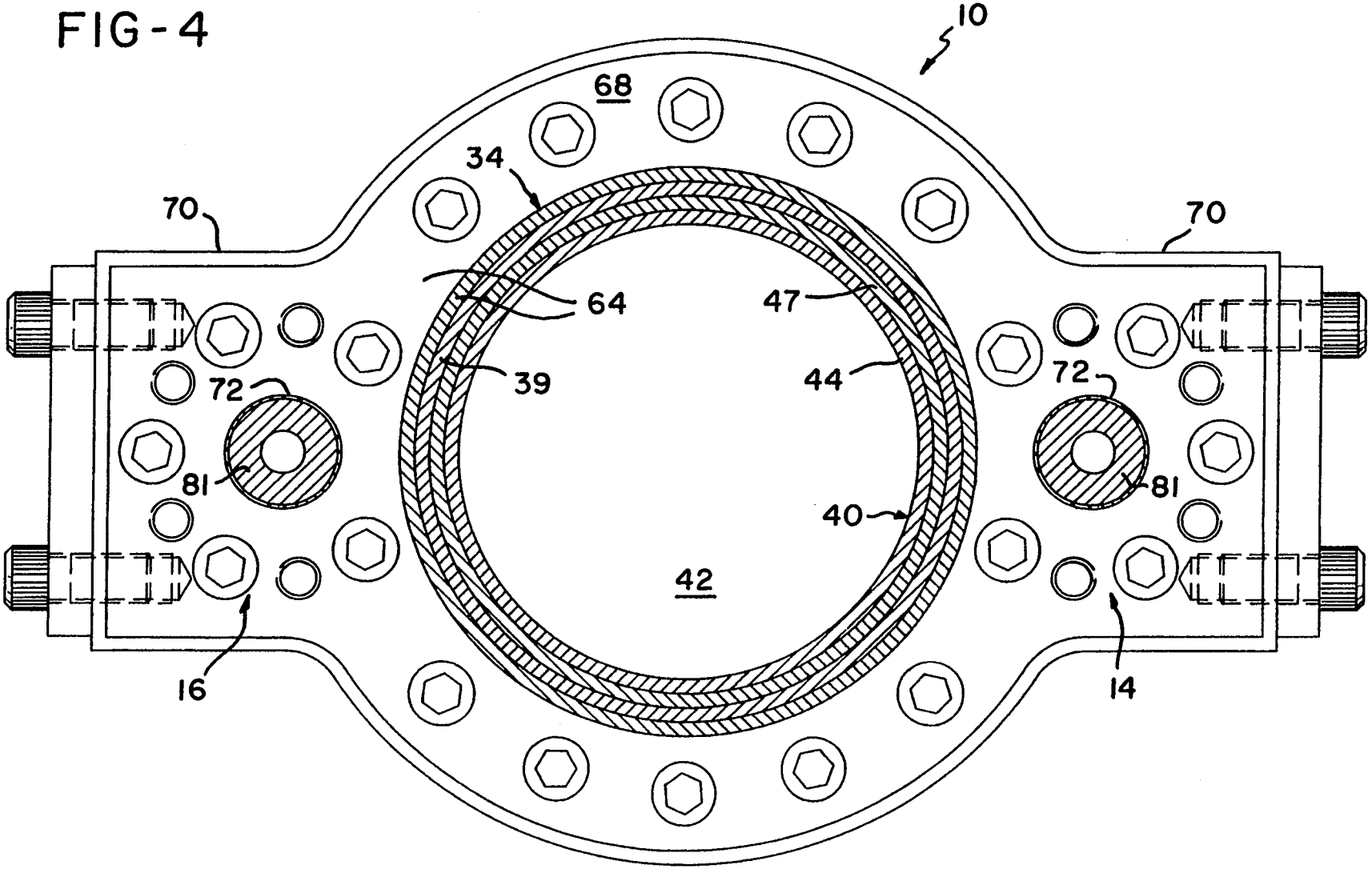
FIG. 4 is a detail cross-sectional view of the valve bodies and cylinder end cap taken along line 4—4 in FIG. 2.

It has been found that valves supplying gas to and from the expansion engine are significant sources of failure and heat loss in expansion engines. Several features of the present invention which follow further address this problem. In particular, as shown in FIG. 4, the cylinder assembly end cap 68, and the inlet and outlet valve bodies 70 are machined from a single piece or block of material, preferably titanium. Referring again to FIG. 1, inlet and outlet openings 90 and 92 interconnecting the valves and cylinder assembly are machined in the block, and inlet and outlet tubes 94 and 96 are machined in to the inlet and outlet valves 14 and 16, respectively. The combination of these elements in a single piece or block of material eliminates cold seals at and between the valves and the expansion cylinder, eliminating sources of helium leaks which have long contributed to failure of prior art expansion engines. Moreover, the combination of these components in a single block of material eliminates dimensional variations, misalignment, and mis-assembly which may occur during fabrication, and improves the accuracy with which the second ends 28, 32 of the inlet and outlet valves 14 and 16 may be assembled in biased relationship. Alignment can be assured by aligning the valve housings 72 with studs or pins extending from the surface of the block of material. Consequently, the desired alignment and secure connection for long term operation at cryogenic temperatures is achieved, avoiding unnecessary stress and undue wear on the cylinder assembly 12 and valves 14, 16, as well as avoiding lateral misalignment which can adversely effect the seals 54 and bearings 56 at their first ends.

For reduced heat loss, it is preferred that the material used for this combined component is titanium. Compared to a typical alternate material, stainless steel, which is widely used in cryogenic applications, titanium has approximately half the thermal conductivity, half the thermal expansion, half the weight, and twice the strength. Thus, used in accordance with the present invention, in the combined component, it will exhibit less contraction during cooldown, which means less bias needs to be applied to the valves upon initial assembly, reducing the wear therein during cooldown. Where titanium is used, the inlet and outlet valves 14 and 16 are separated by only an additional 0.012 inches at their second ends. To achieve the same strength of connection, titanium requires less mass, requiring less cooldown time. Its lower thermal conductivity results in less heat leak to the cold end of the expansion cylinder, having a direct impact on engine efficiency.

To further reduce heat leak through the valves, the valve housings 72 and valve stems 78 are long, and machined to close tolerances such as are required to produce laminar flow to reduce heat leak therebetween (e.g. 0.001 to 0.003 inches gap for a stem of approximately half inch diameter). As well, as shown in FIGS. 1A and 2, the valve stem 78 includes a tube section 80 rather than a solid stem to reduce the material cross-section and reduce conductive heat leak down the valve. It is preferred to pack the tube section 80 with glass wool (not shown) or other suitable material to prevent convective currents and inhibit heat leak internally in the valve stem 78 during cooldown, and to act as a thermal shield when the expansion engine is at liquid helium temperatures. As well, the reduced cross-section of the tube section 80 provides flexibility in the valve stem 78 which reduces the wear on the valve components when operating in the biased condition during initial cooldown.

Material choices for the valve components have also been made with both thermal considerations and reliability in mind. The valve design of the present invention eliminates the need for lubrication or moving mechanical seals at cryogenic temperatures. Preferably the tube section 80 and the valve housing 72 are made of low conductivity, thin-walled tube, preferably stainless steel, to minimize static heat leak. The valve heads 74 are preferably made of tool steel whose coefficient of thermal expansion is matched to the titanium valve body 70. Preferably, the valve heads 74 are machined, heat treated, super-polished, and then ion implanted for extreme hardness, resulting in a Rockwell C75 to 80 surface hardness. When completed, the valve stems 78 are teflon impregnated into the porous, hard-coated surface. This treatment produces extreme durability and lubricity which assists in reducing wear during cooldown, and assures reliable continuing operation.

Further, by way of example, to produce a gas bearing will typically require machining the valve head 74 to approximately 0.0003 inches clearance, or approximately 0.00015 inches clearance on a side. As shown in FIGS. 2 and 2A, the valve body 70 further includes a valve sleeve 71 to which such tolerances are established.

Regardless of the embodiment, the tight tolerances desired for the valves 14, 16 emphasize the significance of using titanium, which has a low coefficient of thermal expansion, for the valve bodies 70 and cylinder assembly end cap 68. That is, because titanium exhibits lower thermal expansion during cooldown, less initial valve bias from true alignment is required, and less potential exists for contact between the valve head 74 and valve body 70 as they operate during cooldown.

Moreover, given the desired material treatments, and tight tolerances for the valves 14, 16, welding of the valve head 74 to the valve stem, and overall alignment of the assembled valve stem 78 must be assured. Welding the finished head to the valve stem 78 would adversely effect the desired properties of the valve head, and perfect alignment of the valve head 74 and stem 78 over the length thereof is problematic. Referring again to FIGS. 1, 1A and 2A, in accordance with the present invention, to achieve highly accurate alignment, the valve stem 78 further includes locking tapers at each end to connect a coupling at one end and the valve head at the other end. The locking tapers include first and second tapered sockets 82 and 84, respectively, machined into blocks 81, preferably of stainless steel, welded at opposite first and second ends of the tube section 80. Shown in FIG. 1, a coupling 86 having a tapered dowel 88 matching the first tapered socket 80 is provided for frictional, locking connection into the first tapered socket 82 at the first (ambient) end. Shown in FIGS. 1A and 2A, the valve head 74 further includes a tapered dowel 76 matching the second tapered socket 84 for frictional, locking connection thereinto. A Morse taper is preferred for these ends, and high precision machining results in highly accurate alignment of the assembled valve head and valve stem components, without welding.

Figure 5:
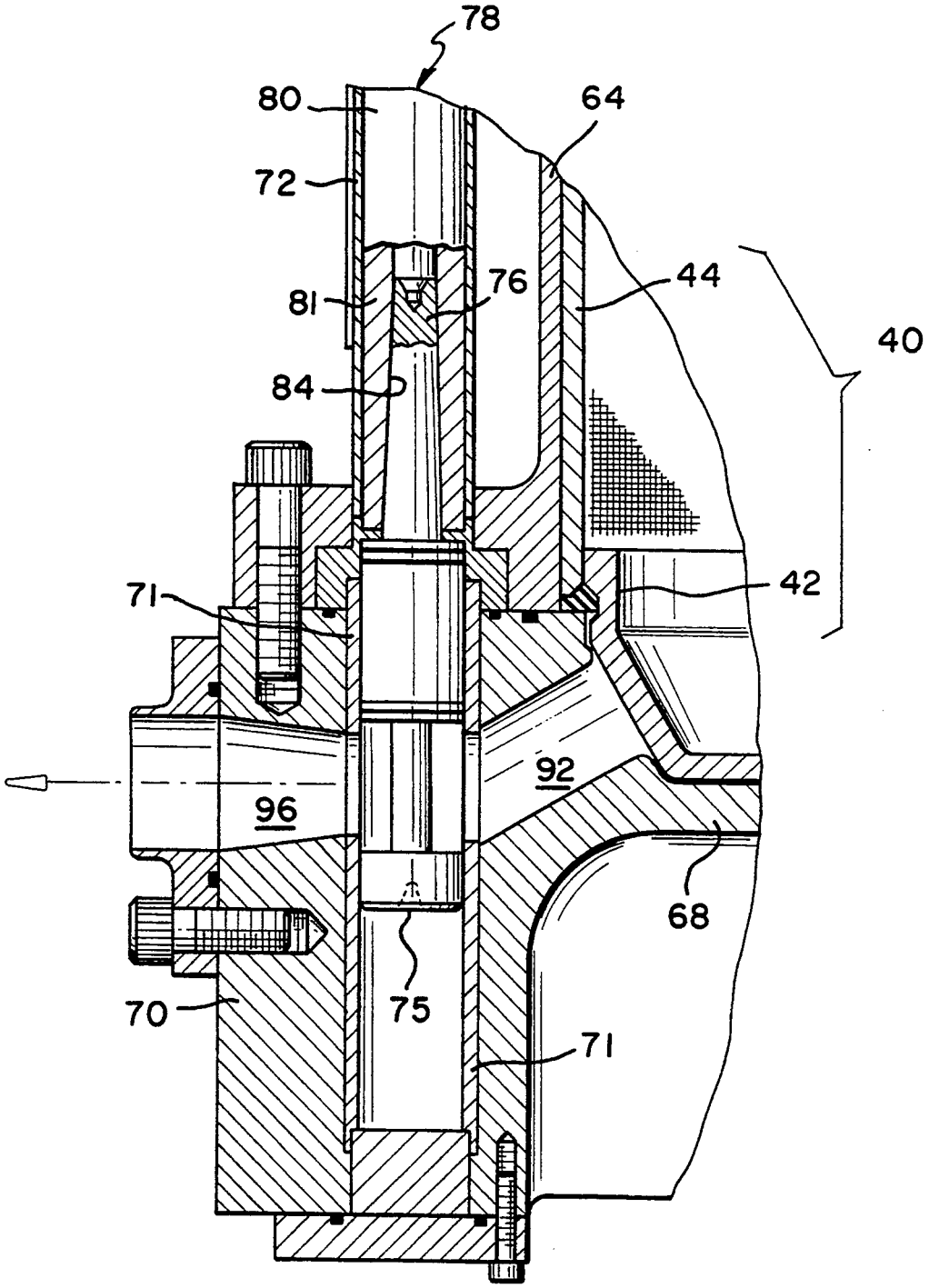
FIG. 5 is a detail cross-sectional view of a third valve design shown in the embodiment of FIG. 1.

As may be seen in FIGS. 1–2A and 5, the valves 14, 16 may be designed as angle or poppet valves with a valve seat 73 (FIGS. 1 and 1A), without a valve seat (FIGS. 2 and 2A), or as a spool valve (FIG. 5).

Referring to FIGS. 1 and 2, where the valve body 70 defines an angled flow path therethrough, a first port (which in the preferred embodiment is the same as inlet or outlet openings 90, 92) provides lateral fluid pressure on the side of the valve head 74, while a second port (the same as inlet and outlet tubes 94, 96) provides fluid pressure on the end of the valve head. Shown best in FIG. 2A, to further improve reliability and reduce lateral pressure on the valves, in accordance with the present invention, means for equalizing the lateral pressure on the valve head are provided. Such equalizing means include a recess 98 in the valve body 70 having an area approximately equal to the area of the first port at the valve head 74. The recess 98 is positioned substantially in opposing relationship to the first port at the valve head 74. The means for equalizing lateral pressure further includes a peripheral groove 100 around the outer surface of the valve head 74 which is positioned to communicate pressure to the recess 98 when the valve 14, 16 is in a closed position. The equalizing means thereby substantially equalizes pressure on the valve head 74 when the valve is closed, and reduces the potential for contact between the valve components during operation.

FIGS. 2 and 2A also discloses that a valve sleeve 71 may be used in accordance with the present invention. The valve sleeve 71 is preferably made of tool steel which has been hardened, ground, and super-polished for durability and reliability. It is understood that the valve design of FIG. 2 does not require use of a valve sleeve 71, and could be incorporated into the expansion engine of FIG. 1. Conversely, it is understood that the valve design of FIG. 1 could be incorporated into the expansion engine of FIG. 2, and used with a valve sleeve 71.

As shown in FIG. 1, where a valve seat 73 is provided, the valve seat 73 is preferably made of high molecular weight polyethylene, for improved durability and reliability. Other conventional valve seat materials, such as Teflon and KEL-F may be used, but are less durable. No additional seals are provided at the valve seat, and sealing is provided by direct contact between the valve seat 73 and the valve head 74. Such contact causes the valve head to find its center, countering any lateral forces due to gas pressure. Thus equalizing means are not preferred in the embodiment of FIG. 1 where a valve seat 73 is provided. In addition to sealing at the valve seat 73, in the valve design of FIG. 1, the gas bearing between the valve head 74 and valve body 70 continues to serve as a seal. In accordance with the valve of FIG. 1, the more positive shut-off obtainable with the valve seat 73 may be a distinct advantage in other applications, for example where the present invention is applied in use as a liquid helium pump.

As shown in accordance with the spool valve of FIG. 5, a pilot guide 75 is incorporated in the spool valve to counter lateral forces and help resist side loading. Such a pilot guide 75 may be a distinct advantage in some applications, for example, where the present invention is applied in use as a cold gas compressor.

As regards the different valve designs of FIGS. 1A, 2A and 5, the angle valve of FIG. 1 has the disadvantage of requiring additional closing pressure to satisfy seat material loading requirements needed to form a positive seal at valve seat 73. The additional closing pressure requires more mechanical force than is otherwise necessary to overcome system pressure, e.g. up to two and one-half times the force. However, once closed, the lateral pressures thereon may be relieved. The valves of FIGS. 2 and 5 have the advantage of requiring closing only against the system pressure in the lines. However, such fluid pressure is applied laterally to the spool valve, increasing the possibility of contact and wear between the valve head 74 and valve body 70. It is preferred in accordance with the present invention to use the valve of FIG. 1 for simplicity, although each valve type has application in different types of systems applications.

Referring again to FIGS. 1 and 1A, the structure of the piston 40 is shown, as preferred. Preferably, the piston 40 includes a piston head 42, piston tube 44 and piston end plate 43, and is hollow. Preferably the piston 40 is made of titanium for light weight, low thermal conductivity, low thermal expansion and high strength. As indicated above with respect to the valves 14, 16, the use of a tube shape also reduces the cross-sectional area available for conductive heat leak. To further reduce heat leak, the hollow piston 40 is substantially filled with insulating material, such as perlite, or other similar material, and then purged with carbon dioxide gas. The carbon dioxide gas will cryopump inside the piston 40 upon cooldown, creating an insulating vacuum therein. The perlite or similar material serves to prevent convection currents inside the piston 40, and also acts as a thermal shield when the carbon dioxide gas cryopumps to the piston walls. The reduced heat leak will have a direct impact on expansion engine efficiency.

Further, in like fashion as with the valves, as shown in FIG. 1, the piston 40 includes a first portion 45 of its surface which is machined to close tolerances such as are required to produce laminar flow to reduce heat leak therealong (e.g. approximately 0.003 inches gap for a piston. Further, in like fashion as with the valves, a second portion 46 of the piston surface of the piston 40 and the inner walls of the cylinder assembly 34 are machined to produce a gas bearing therebetween, eliminating the need for lubrication or cold moving mechanical seals. Again, by way of example, to produce a gas bearing at the piston will typically require machining the piston tube 44 to approximately 0.0003 inches diameter clearance, or approximately 0.00015 inches clearance on a side. Where the piston 40 and/or cylinder assembly 34 further includes a piston sleeve 47 or cylinder assembly sleeve 39, as shown in FIGS. 2A and 4, such tolerances are established therebetween to produce the gas bearing.

In accordance with the first embodiment of the present invention shown in FIG. 1, for improved durability, reduced friction, and higher reliability, it is preferred that the piston is made of titanium, and that the surfaces are teflon impregnated porous hard-coated surfaces for high hardness and lubricity. No heat treatment of the piston surfaces is preferred. No sleeves are provided for the piston or cylinder in this embodiment.

By contrast, in accordance with the second embodiment of the present invention shown in FIGS. 2A and 4, a piston sleeve 47 and a cylinder assembly sleeve 39 are provided for hardness, strength and lubricity. The piston sleeve 47 in the second portion 46 of the piston tube 44 surface is preferably comprised of tool steel which has been hardened, ground, and ion implanted, much in like fashion as the valve heads 74. The cylinder sleeve 39 is preferably made of tool steel which has been hardened, ground and super-polished but not ion implanted, much like valve sleeves 71. In the embodiment of FIG. 2, the adjacent surfaces of the cylinder assembly 34 and cylinder sleeve 39 define the gas bearing. Preferably the tool steel of both the cylinder sleeve 39 and piston sleeve 47 have coefficients of expansion matching the underlying titanium of the cylinder assembly 34 and piston 40, respectively.

As shown in FIGS. 1 and 2, the expansion engine 10 of the present invention is preferably positioned so that the second end 24 of the expansion cylinder 12 is positioned lower than its first end 22. It is further preferably positioned so that the outlet opening 92 extends in a downward direction to drain liquid which may be formed in the variable volume during expansion. In this regard, the present invention contemplates that the expansion cylinder 12 may operate in the "wet" condition, improving efficiency. Further, while the piston head 42 may take on many shapes, it is preferred that the piston head 42 is generally shaped as a truncated conical frustum. This shape permits the inlet and outlet openings 90, 92, to be positioned at other than the bottom of the cylinder reducing the amount of dead volume in lines extending to the valves 14, 16. As further shown in FIGS. 1A, 2A and 5, the cylinder assembly end cap 68 is further shaped to substantially match the shape of the piston head 42 to eliminate as nearly as possible the dead volume between the cylinder assembly end cap 68 and piston head 42. Dead volume in accordance with the present invention is estimated to be only about 4% compared to 15% to 18% dead volume in conventional expansion engines. Given this shape, the outlet opening 92 is able to extend diagonally downward from a conical surface of the cylinder assembly end cap 68 to substantially drain or blow out more easily any liquid which is formed in the cylinder assembly 34 during operation. Eliminating dead volume, and draining liquid formed in the expansion cylinder improves the operating efficiency of the expansion engine 10, and permits a more compact design.

Figure 3:
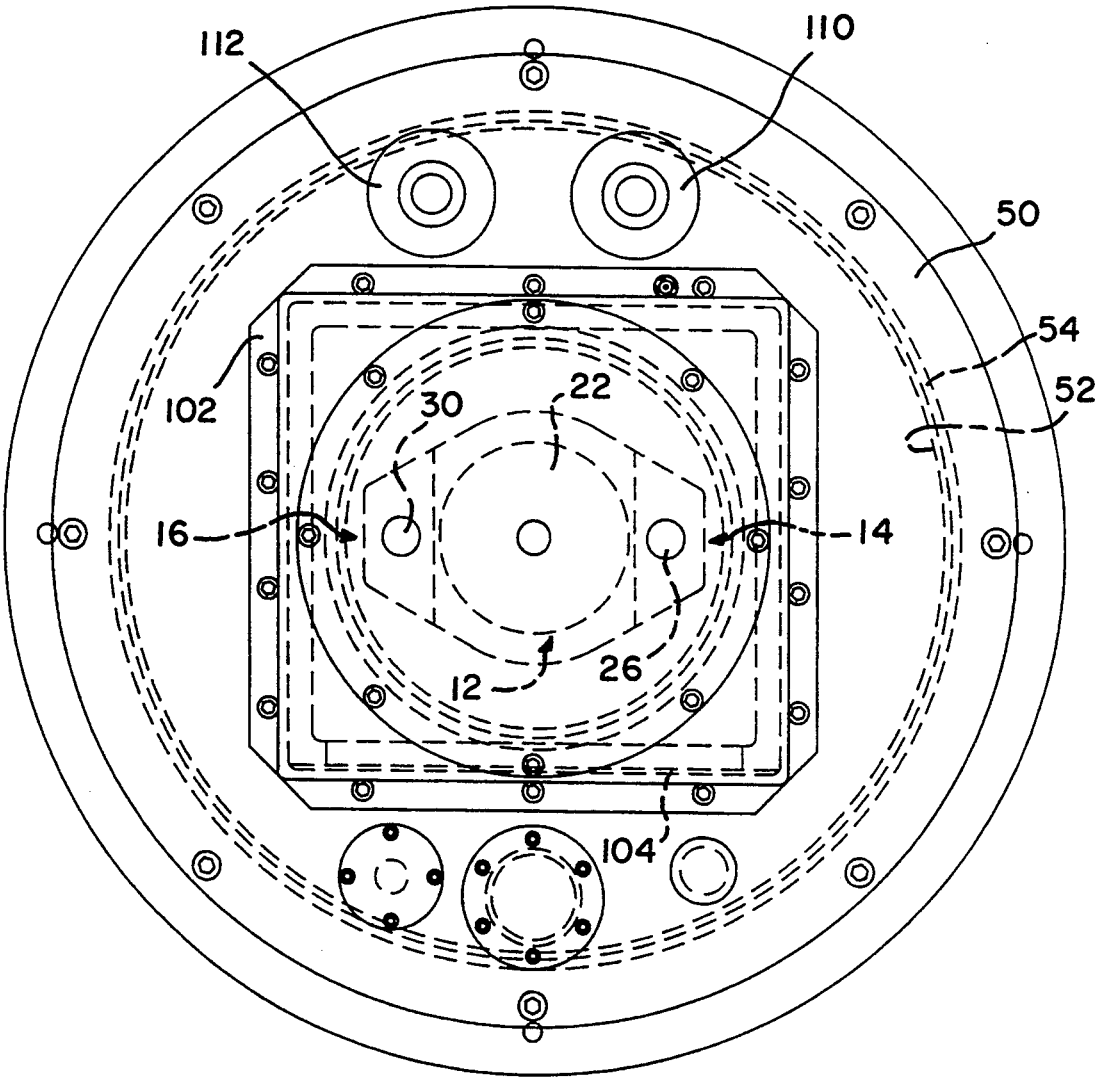
FIG. 3 is a schematic top plan view of the top of the expansion engine of FIGS. 1 and 2.

Referring now to FIGS. 1–3, a further feature of the present invention which enhances reliability is upper seal housing 102. Upper seal housing 102 is a helium gas-purged housing which encloses the upper, first ends 22, 26, 30 of the expansion cylinder 12, inlet valve 14, outlet valve 16, and at least a portion of the mounting flange 50. The upper seal housing 102 has a helium gas pressure therein greater than ambient atmospheric pressure, which inhibits air and oil in-leakage which otherwise contaminates the expansion engine and eventually leads to failure by freezing and damaging components. As well, the upper seal housing 102 prevents dirt and oil from attaching to the valve stems 78 and piston 40 and scoring the valve and expansion cylinder surfaces as they reciprocate.

As shown in FIGS. 1–3, the upper seal housing 102 is bolted onto the mounting flange 50, and in the preferred embodiment, its flange serves as part of the assembly which functions as the mounting flange 50, and provides the linear bearings 56 and sliding seals 54 which seal the first ends of the valves 14, 16 and the piston 40. A sealed viewing window 104 is provided for convenient inspection of connections by an operator. The upper seal housing 102 is preferably made of aluminum for light weight, and the window is preferably made of a transparent resin, such as Plexiglas or Lucite, and sealed with a suitable gasket. The helium gas is added to the upper seal housing 102 either by initial purge followed by sealing of the volume, or by initial purge followed by connection to a continuous supply of helium. The latter is preferred to assure positive pressure in the upper seal housing 102 during long-term operation. As further shown, the means 20 for operating preferably extend into (but may remain entirely outside) the upper seal housing 102 for connection to the piston 40, inlet valve 14 and outlet valve 16. However, because of the positive pressure of helium gas, and the minor difference in pressure between inside the housing and ambient, the seals in the upper seal housing 102 through which connections pass to the means 20 for operating, are not as critical as those seals between the upper seal housing 102 and the internal areas of the valves 14, 16 and the piston 40. Although the pressures in the valves 14, 16 and piston are relatively high, and the pressure in the upper seal housing 102 relatively low, the upper seal housing 102 effectively puts helium gas on both sides of the moving valve and piston seals, inhibiting in-leakage of damaging air gases, dirt and oil.

While the present invention has been described in the context of operation in helium refrigerators and liquefiers, and gaseous helium is preferred, operation with other gases remains possible. By way of example and not limitation, such other gases include methane, hydrogen, and nitrogen. In that case, the piston stroke may have to be altered slightly, and the upper seal housing 102 purged with the same type of gas that is being expanded in the variable volume 48 of expansion cylinder 12. As well the present invention is scaleable to achieve a wide range of different capacities for different gases. That is, without redesigning the essential structural features, the components may be sized as necessary to achieve desired capacities, or the piston stroke length or piston diameter may be changed.

In operation, the means 20 for operating drives the piston 40, inlet valve 14, and outlet valve 16 in timed relationship. Preferably, side loading on the first ends thereof is limited. Mechanical drives commercially available, adaptable to the present invention, or within the capability of one skilled in the art, permit only initial settings for valve timing and stroke length. Any variation in their operation after cooldown to change the output of the expansion engine is limited, and can be effected only by changing the speed of operation. The stroke length which is preferred for helium gas is generally in the range of 65% of the theoretical stroke length required for expansion.

In general, operation would call for the inlet valve 14 to open with the piston 40 at bottom dead center. The inlet gas pressure will, in many cases, drive the piston 40 upward, and the means 20 for operating will tend to act more like a brake during this phase. The expansion cylinder will typically open some amount, typically approximately 30% (although it may be more or less) of the desired stroke length, at which time the inlet valve closes. Continued upward motion of the piston 40 expands the gas. At the top of the stroke, typically expected to be about 65% of the theoretical stroke length (although it may be more or less), the outlet valve 16 is opened. The piston 40 then moves back down to bottom dead center, whereupon the outlet valve 16 closes, the inlet valve 14 opens, and the cycle begins again. It is anticipated that the low gaseous helium leakage rates and high thermal efficiency of the present invention will make operation at lower speeds (lower cycles per second) possible which, in turn, reduces wear on the seals 54 and bearings 56 and adds to reliability.

Independent operation of the valves 14, 16 and piston 40, with separate control of stroke and speed, for example, using a linear drive mechanism (not shown) and controller means 60 is preferable. Given such a means 20 for operating and controller means 60, efficient operation of the expansion engine in a refrigeration/-liquefaction system may be achieved at substantially optimum conditions throughout the operating range from initial start-up at ambient through steady state operation at designed operating points.

During long-term operation, it is anticipated that the high reliability features incorporated herein will permit operation of the present invention with mean times between failure (MTBF) of at least 10,000 hours which exceeds more than twice the MTBF times of commercially available expansion engines. Moreover, the present invention is designed to provide for subassembly (such as the valve stems 78 and upper seal housing 102), and testing of subassemblies which not only improve initial fabrication times and costs, but which make disassembly for annual overhaul and maintenance less time-consuming and less costly. For example, when annual maintenance is performed, only seals 54 and bearings 56 at the ambient end, which are subjected to component motion and wear, are replaced. Static seals formed by metal O-rings 58 need not be disturbed during such maintenance and remain in place. During routine maintenance, although gas bearings theoretically result in no wear, the valve stems 78 and piston 40 may be pulled to inspect for damage due to contamination or incidental wear. Due to the structure of the present invention, it may be appreciated from FIGS. 2 and 5 that the valve body 70 may be bored (and the bore capped if desired, as shown in FIG. 5) so that the valve stems 78 may be removed from either end of the valves 14, 16, without effecting the various static seals or connecting process piping (not shown) in the vacuum chamber 52.

In addition to serving as an expansion engine, the durability of design and material choices permit the present invention to further be used as a cryogenic liquid booster pump, for example, for liquid helium. As well, it may be applied as a cold gas compressor for very low temperature gases.

While certain representative embodiments and details have been shown for purposes of illustrating the invention, it will be apparent to those skilled in the art that various changes in the expansion engine and methods disclosed herein may be made without departing from the scope of the invention, which is defined in the appended claims.

What is claimed is:

1. An expansion engine for cryogenic refrigerators and liquefiers, comprising:

A) an expansion cylinder having a first end adapted for exposure to ambient temperatures, and a second end adapted for exposure to cooler temperatures, said expansion cylinder including:

a cylinder assembly having a first end and a second end and extending generally from said first end to said second end of said expansion cylinder; and a piston slidably disposed in the cylinder assembly for reciprocating motion to define at said second end a variable volume within said cylinder assembly for gas expansion;

B) means for mounting the expansion engine, including a mounting flange rigidly connected to said first end of said cylinder assembly;

C) an inlet valve to control fluid flow into said variable volume, said inlet valve having a first end and a second end, the second end thereof rigidly connected to the second end of said cylinder assembly, and the first end thereof slidably disposed in said mounting flange;

D) an outlet valve to control fluid flow from the variable volume, said outlet valve having a first end and a second end, the second end thereof rigidly connected to the second end of said cylinder assembly, and said first end thereof slidably disposed in said mounting flange; and E) means for operating said expansion cylinder, inlet valve and outlet valve in timed relationship;

whereby said inlet valve and said outlet valve are supported by respective connections to said cylinder assembly such that upon cooldown, thermal contraction of said cylinder assembly is accompanied by sliding motion of said inlet valve and said outlet valve at their respective first ends through said flange at generally ambient temperatures.

2. The expansion engine of claim 1 wherein:

said inlet valve and said outlet valve are in spaced relationship; and at ambient temperatures the second ends of said inlet valve and said outlet valve are more widely spaced apart than the first ends thereof, and at substantially steady state cryogenic operating temperatures the second ends of said inlet valve and said outlet valve are spaced apart a distance generally equal to the spacing between the first ends thereof;

whereby the inlet valve and outlet valve adjust from being biased apart at their second ends at ambient temperatures, to being in generally parallel, spaced relationship upon cooldown to said operating temperatures.

3. The expansion engine of claim 1 wherein:

said cylinder assembly includes a cylinder end cap disposed at said second end of said cylinder assembly;

said inlet valve includes an inlet valve body disposed at the second end of said inlet valve; and said outlet valve includes an outlet valve body disposed at the second end of said outlet valve; and said cylinder end cap, said inlet valve body, and said outlet valve body are all substantially formed in a single piece of material.

4. The expansion engine of claim 1 wherein said second end of said expansion cylinder is positioned lower than said first end and, at said second end of said expansion cylinder:

said piston includes a piston head generally shaped as a truncated conical frustum, and;

said cylinder assembly includes:

an end cap shaped to substantially match the shape of said piston head such that the dead volume between said end cap and said piston head in said variable volume is substantially minimized; and an inlet opening and an outlet opening, said outlet opening positioned diagonally downward from a conical surface of said end cap to drain liquid formed in said cylinder assembly during operation.

5. The expansion engine of claim 1 wherein:

said piston is hollow and includes a piston head, piston tube and piston end plate; and said hollow piston is substantially filled with material including perlite and carbon dioxide gas for insulation.

6. The expansion engine of claim 1 wherein:

said piston includes a piston head, piston tube and a piston end plate; and at least a portion of the surface of said piston tube is separated from adjacent surfaces of said cylinder assembly a distance which defines a gas bearing.

7. The expansion engine of claim 6 wherein said portion of the surface of said piston tube and adjacent surfaces of said cylinder assembly each include a sleeve comprised of tool steel, the distance between which sleeves defines a gas bearing.

8. The expansion engine of claim 1 wherein said inlet valve and said outlet valve each include, respectively:

a valve body disposed at the second end of the valve;

a valve housing extending from the valve body toward the first end of the valve;

a valve head slidably disposed for reciprocal motion in portions of the valve body and valve housing to control flow through the valve; and a valve stem connected to and extending from the valve head to the first end of the valve and slidably disposed for reciprocal motion in portions of the valve body and valve housing for operation of the valve.

9. The expansion engine of claim 8 wherein:

said valve stem including:

a tube section extending generally between the first and second ends of the valve, the tube section having first and second tapered sockets, respectively, at its opposite ends; and a coupling having a tapered dowel matching said first tapered socket for frictional connection thereinto;

said valve head including a tapered dowel matching said second tapered socket for frictional connection thereinto.

10. The expansion engine of claim 8 wherein:

at least a portion of the surface of the valve head is separated from adjacent surfaces of the valve body a distance which defines a gas bearing.

11. The expansion engine of claim 8 wherein the valve body defines an angled flow path therethrough including:

a first port providing lateral fluid pressure on the side of said valve head;

a second port providing axial fluid pressure on the end of the valve head; and means for equalizing lateral pressure on the valve head, said means for equalizing comprising:

a recess in the valve body having an area approximately equal to the area of the first port at the valve head and positioned substantially in opposing relationship to the first port at the valve head; and a peripheral groove around the outer surface of the valve head positioned to communicate pressure to the recess when the valve is closed;

whereby lateral pressure on the valve head is substantially equalized when the valve is closed.

12. The expansion engine of claim 1 further comprising a gas purged upper seal housing enclosing the first ends of said expansion cylinder, inlet valve, outlet valve, and at least a portion of said mounting flange, said gas comprising the same type of gas as the fluid flowing through the expansion cylinder, said upper seal housing having a gas pressure therein greater than ambient atmospheric pressure, and said means for operating extending into said upper seal housing for connection to said piston, inlet valve and outlet valve.

13. The expansion engine of claim 1 wherein:

said inlet valve and said outlet valve are in spaced relationship;

at ambient temperatures the second ends of said inlet valve and said outlet valve are more widely spaced apart than the first ends thereof, and at substantially steady state cryogenic operating temperatures the second ends of said inlet valve and said outlet valve are spaced apart a distance generally equal to the spacing between the first ends thereof;

said inlet valve and said outlet valve each include, respectively, a valve body disposed at the second end of the valve;

said cylinder assembly includes a cylinder end cap disposed at said second end of said cylinder assembly; and said cylinder end cap, said inlet valve body, and said outlet valve body are all substantially formed in a single piece of material;

whereby the inlet valve and outlet valve adjust from being biased apart at their second ends at ambient temperatures, to being in generally parallel, spaced relationship upon cooldown to said operating temperatures substantially due to thermal contraction of said single piece of material.

14. The expansion engine of claim 13 wherein said inlet valve and said outlet valve each further include, respectively:

a valve housing extending from the valve body toward the first end of the valve;

a valve head slidably disposed for reciprocal motion in portions of the valve body and valve housing to control flow through the valve, said valve head including a tapered dowel;

a valve stem connected to and extending from the valve head to the first end of the valve and slidably disposed for reciprocal motion in portions of the valve body and valve housing for operation of the valve, said valve stem including:

a coupling having a tapered dowel;

a tube section extending generally between the first and second ends of the valve, said tube section having first and second tapered sockets, respectively, at its opposite ends, said second tapered socket matching said tapered dowel at said valve head for frictional connection therewith, and said first tapered socket matching said tapered dowel at said coupling for frictional connection therewith.

15. The expansion engine of claim 14 further comprising a gas purged upper seal housing enclosing the first ends of said expansion cylinder, inlet valve, outlet valve, and at least a portion of said mounting flange, said gas comprising the same type of gas as the fluid flowing through the expansion cylinder, said upper seal housing having a gas pressure therein greater than ambient atmospheric pressure, and said means for operating extending into said upper seal housing for connection to said piston, inlet valve and outlet valve.

16. An expansion engine for cryogenic refrigerators and liquefiers, comprising:

A) an expansion cylinder having a first end adapted for exposure to ambient temperatures, and a second end adapted for exposure to cooler temperatures, said expansion cylinder including:

a cylinder assembly extending generally from said first end to said second end; and a piston slidably disposed in the cylinder assembly for reciprocating motion to define at said second end a variable volume within said cylinder assembly for gas expansion;

B) an inlet valve to control fluid flow into said variable volume, said inlet valve having a first end and a second end;

C) an outlet valve to control fluid flow from the variable volume, said outlet valve having a first end and a second end;

D) means for mounting the expansion engine, including a mounting flange supporting said cylinder assembly, said inlet valve and said outlet valve; and E) means for operating said expansion cylinder, inlet valve and outlet valve in timed relationship; and wherein:

said inlet valve and said outlet valve are in spaced relationship; and at ambient temperatures the second ends of said inlet valve and said outlet valve are more widely spaced apart than the first ends thereof, and at substantially steady state cryogenic operating temperatures the second ends of said inlet valve and said outlet valve are spaced apart a distance generally equal to the spacing between the first ends thereof;

whereby the inlet valve and outlet valve adjust from being biased apart at their second ends at ambient temperatures, to being in generally parallel, spaced relationship upon cooldown to said operating temperatures.

17. The expansion engine of claim 16 wherein:

said cylinder assembly includes a cylinder end cap disposed at said second end of said cylinder assembly;

said inlet valve and said outlet valve each include, respectively, a valve body disposed at the second end of the valve;

said cylinder end cap, said inlet valve body, and said outlet valve body are all substantially formed in a single piece of material.

18. The expansion engine of claim 16 wherein said inlet valve and said outlet valve each include, respectively:

a valve body disposed at the second end of the valve;

a valve housing extending from the valve body toward the first end of the valve;

a valve head slidably disposed for reciprocal motion in portions of the valve body and valve housing to control flow through the valve, said valve head including a tapered dowel; and a valve stem connected to and extending from the valve head to the first end of the valve and slidably disposed for reciprocal motion in portions of the valve body and valve housing for operation of the valve, said valve stem including:

a coupling having a tapered dowel;

a tube section extending generally between the first and second ends of the valve, the tube section having first and second tapered sockets, respectively, at its opposite ends; and said second tapered socket matching said tapered dowel at said valve head for frictional connection therewith, and said first tapered socket matching said tapered dowel at said coupling for frictional connection therewith.

19. An expansion engine for cryogenic refrigerators and liquefiers, comprising:

A) an expansion cylinder having a first end adapted for exposure to ambient temperatures, and a second end adapted for exposure to cooler temperatures, said expansion cylinder including:

a cylinder assembly extending generally from said first end to said second end; and a piston slidably disposed in the cylinder assembly for reciprocating motion to define at said second end a variable volume within said cylinder assembly for gas expansion;

B) an inlet valve to control fluid flow into said variable volume, said inlet valve having a first end and a second end;

C) an outlet valve to control fluid flow from the variable volume, said outlet valve having a first end and a second end;

D) means for mounting the expansion engine, including a mounting flange supporting said cylinder assembly, said inlet valve and said outlet valve;

E) means for operating said expansion cylinder, inlet valve and outlet valve in timed relationship; and F) a gas purged upper seal housing enclosing the first ends of said expansion cylinder, inlet valve, outlet valve, and at least a portion of said mounting flange, said gas comprising the same type of gas as the fluid flowing through the expansion cylinder, said upper seal housing including a positive pressure of said gas, and said means for operating extending into said upper seal housing for connection to said piston, inlet valve and outlet valve.

20. The expansion engine of claim 19 wherein:

said piston includes a piston tube, and at least a portion of the surface of said piston tube is separated from adjacent surfaces of said cylinder assembly a distance which defines a gas bearing;

said inlet valve and said outlet valve each include, respectively:

a valve body disposed at the second end of the valve; and a valve head slidably disposed for reciprocal motion in portions of the valve body to control flow through the valve; and in at least one of said inlet and outlet valves, at least a portion of the surface of the valve head is separated from adjacent surfaces of the valve body a distance which defines a gas bearing.

* * * * *